US006386473B1

(12) United States Patent
Vitaletti

(10) Patent No.: US 6,386,473 B1
(45) Date of Patent: May 14, 2002

(54) STORAGE DEVICE FOR VACUUM HOSE

(76) Inventor: Enrico Vitaletti, 1406 Fairview, Clarks Summit, PA (US) 18411

( * ) Notice: Subject to any disclaimer, the term of this patent is extended or adjusted under 35 U.S.C. 154(b) by 0 days.

(21) Appl. No.: 09/625,957

(22) Filed: Jul. 26, 2000

(51) Int. Cl.[7] ..... B65H 75/40; B65H 75/28

(52) U.S. Cl. ..... 242/403.1; 242/407; 242/584.1; 137/355.27

(58) Field of Search ..... 242/403.1, 407, 242/402, 584.1, 584, 125.1; 137/355.26, 355.27; 15/1.7; 4/490

(56) References Cited

U.S. PATENT DOCUMENTS

| | | | | | |
|---|---|---|---|---|---|
| 321,172 | A | * | 6/1885 | Baldwin | 137/355.26 |
| 2,048,852 | A | | 7/1936 | Dumas | |
| 2,512,756 | A | | 6/1950 | Wasserman | |
| 2,590,963 | A | * | 4/1952 | Hannay | 242/403.1 |
| 3,168,260 | A | * | 2/1965 | Kittelson | 242/584.1 |
| 4,112,963 | A | | 9/1978 | Brubaker | |
| 4,227,661 | A | * | 10/1980 | King et al. | 137/355.27 |
| 4,228,553 | A | * | 10/1980 | Genuit | 242/403.1 |
| 4,512,361 | A | | 4/1985 | Tisbo et al. | |
| 4,586,676 | A | | 5/1986 | Johnston et al. | |

* cited by examiner

*Primary Examiner*—John M. Jillions
(74) *Attorney, Agent, or Firm*—Lorusso & Loud

(57) ABSTRACT

A storage device for a long vacuum hose such as used for cleaning a pool has a frustoconcial member mounted on a reel rotatably supported on a frame. The frustoconical member frictionally fits and secures the end of the vacuum hose to enable the winding of the hose on the reel.

4 Claims, 1 Drawing Sheet

STORAGE DEVICE FOR VACUUM HOSE

BACKGROUND OF THE INVENTION

The invention relates to the storage of vacuum hoses particularly for a pool. Generally a filtering and pump mechanism for a swmming pool has a single connection for connecting a vacuum hose used to provide suction to skimmers, brushes, and other tools used in cleaning and maintenance of the swimming pool. Vacuum hoses for pools are relatively long and are usually stored in a coil in a corner or other location.

It is an object of the present invention to provide a more convenient arrangement for storing vacuum hoses when not in use.

SUMMARY OF THE INVENTION

The invention is summarized in a vacuum hose storage device having a frustoconical member mounted on a reel rotatably mounted on a frame. The frustoconical member is mounted adjacent the hub of the reel and has a shape and size selected to frictionally fit and secure an end of the vacuum hose to enable easy winding of the vacuum hose on the reel.

DETAILED DESCRIPTION OF THE INVENTION

Figure 1:
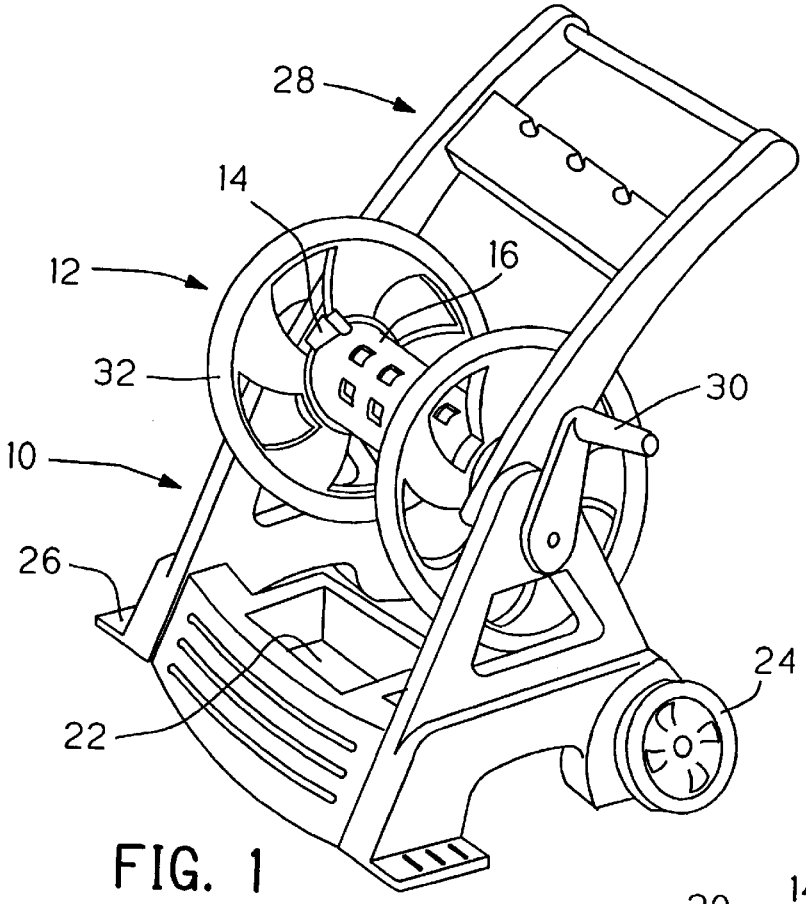
FIG. 1 is a perspective view of a vacuum hose storage device in accordance with one embodiment of the invention.
Figure 2:
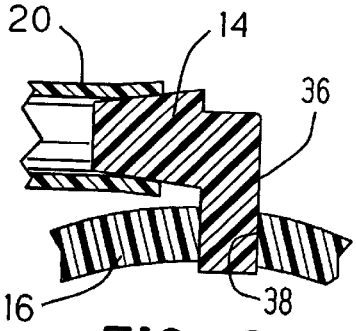
FIG. 2 is a broken away sectional view of a frustoconical member mounted on a hose reel of the vacuum hose storage device of FIG. 1.

A vacuum hose storage device as shown in the embodiment of FIG. 1 includes a frame 10 rotatably supporting a reel 12 with a frustoconical member 14 mounted adjacent the hub 16 of the reel 12. As shown in FIG. 2, this frustoconical member 14 has a size and shape designed to frictionally fit into one end of a vacuum hose 20 so as to secure the one end of the vacuum hose to enable easy winding of the hose on the reel 12.

The frame 10 is a conventional molded frame similar to those employed in portable watering hose reels. A bin 22 is formed in a bottom portion of the frame 10 for storing tools for use with the vacuum hose. A pair of ground engaging wheels 24 (only one wheel 24 shown) are rotatably mounted on the rear of the bottom of the frame 10. Ground engaging pads 26 are formed on the front portion of the bottom of the frame 10. A handle 28 is mounted on the frame 10 to extend upward and rearward from the frame 10 to enable a user to tilt the storage device lifting the pads 16 from engagement with ground and to roll the device on the wheels 24. The handle 28 is preferably mounted with a pivot locked by a conventional detent or locking arrangement (not shown) in the raised position. To provide a lower storage profile the handle can be unlocked and pivoted downward against the rear of the frame.

Figure 3:
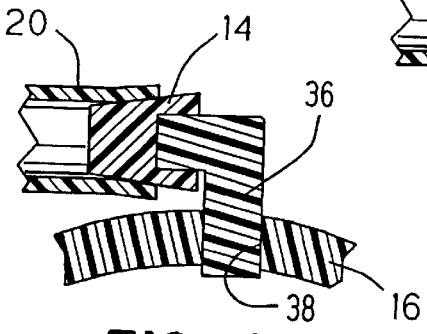
FIG. 3 is a broken away sectional view of a variation of the frustoconical member and its mounting post mounting the frustoconical member on a watering hose reel.
Figure 4:
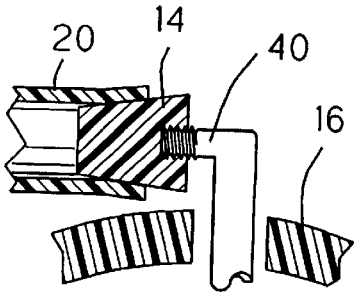
FIG. 4 is a broken away sectional view of another variation of the frustoconical member wherein the frustoconical member is screwed onto a hose nozzle on a watering hose reel.

The reel 12 is rotatably mounted between opposite sides of the upper portion of the frame 10 and is connected to a crank 30 by which a user can rotate the reel 12 and wind the vacuum hose on the reel. Flanges 32 are mounted on opposite ends of the hub 16 to retain the hose on the hub. The frustoconical member 14 is mounted on the reel 12 adjacent the hub 16 and adjacent to one of the flanges 32. The axis of the frustoconical member 14 extends tangential to an imaginary circle coaxial with the hub 16 or extends tangential to the axis of the hose when wound on the reel 12. In the variation of FIG. 2, the frustoconical member 14 is shown molded with an integral post 36 secured in an opining 38 in the hub 16. Various techniques, such as welding, adhesives, fasteners, interfitting parts, etc. can be used to mount the post 36 and the frustoconical member 14 on the hub 16 or on the adjacent flange 32. In the variation of FIG. 3, the post 36 is a separately molded member secured to the frustoconical member 14 in a manner similar to the manner that the post 36 is secured to the hub 16. In the variation of FIG. 4, the frustoconical member 14 is threaded onto a nozzle 40 which is mounted on the reel 12 in a conventional watering hose storage device which has sufficient reel storage size to hold the vacuum hose.

The frustoconical members 14 shown in FIGS. 2, 3 and 4 are solid molded members. However, the frustoconical member 14 may be a hollow or tubular frustum of a cone, a frustoconical arrangement of molded splines, a circularly grooved frustum of a cone, or some other configuration designed to minimize molded material but have adequate strength.

It is intended that the embodiments described above and shown in the accompanying drawings be interpreted as illustrative of the principles of the invention and not as limiting on the spirit and scope of the invention as defined in the following claims.

What is claimed is:

1. A device for storing a vacuum hose comprising:

a frame;

a reel rotatable supported on the frame and having a hubs with a flange at each end of the hub for retaining a vacuum hose wound on the hub, and a conventional water hose male fitting mounted on said reel adjacent one end of said hub;

a frustoconical member tapering from a large diameter end to a small diameter end and having a threaded bore extending inward from said large diameter end and mating with said conventional water hose male fitting;

said frustoconical member having a conical size and shape to friction fit in one end of the vacuum hose;

wheels rotatably mounted on the frame for engaging ground; and a handle mounted on the frame for enabling a user to move the vacuum hose storage device.

2. A device according to claim 1 wherein the frustoconical member has an axis that extends tangential to an axis of a vacuum hose wound on the reel.

3. A device according to claim 1 wherein the frusto conical member is mounted on the hub of the reel.

4. A device according to claim 2 wherein the frustoconical member is mounted on the hub of the reel.

* * * * *